US008225821B2

(12) United States Patent
Breuer et al.

(10) Patent No.: US 8,225,821 B2
(45) Date of Patent: Jul. 24, 2012

(54) PINTLE FOR SPIRAL FABRICS

(75) Inventors: Hans-Peter Breuer, Zell (DE); Jesus Perez, Atizapan (MX); William Luciano, Saratoga Springs, NY (US)

(73) Assignee: Albany International Corp., Albany, NY (US)

( * ) Notice: Subject to any disclaimer, the term of this patent is extended or adjusted under 35 U.S.C. 154(b) by 998 days.

(21) Appl. No.: 11/009,157

(22) Filed: Dec. 10, 2004

(65) Prior Publication Data

US 2006/0005936 A1 Jan. 12, 2006

Related U.S. Application Data

(60) Provisional application No. 60/529,488, filed on Dec. 15, 2003.

(51) Int. Cl.
*D21F 1/12* (2006.01)
*D21F 7/10* (2006.01)
*D03D 25/00* (2006.01)

(52) U.S. Cl. ..... 139/383 A; 139/383 AA; 139/383 R; 162/358.2

(58) Field of Classification Search ..... 139/383 A, 139/383 AA; 162/358.2; 428/257, 225, 428/229
See application file for complete search history.

(56) References Cited

U.S. PATENT DOCUMENTS 3,238,594 A * 3/1966 Schuster ..... 28/141
4,395,308 A 7/1983 Dawes ..... 162/232
4,500,590 A * 2/1985 Smith ..... 428/222
4,567,077 A 1/1986 Gauthier ..... 428/114
4,574,435 A * 3/1986 Luciano et al. ..... 24/33 C
4,632,716 A 12/1986 Smith ..... 156/148
4,827,579 A * 5/1989 Gisbourne ..... 24/391
4,846,231 A * 7/1989 Penven ..... 139/383 AA
5,053,109 A * 10/1991 Penven ..... 162/348
5,104,724 A 4/1992 Hsu ..... 428/222
5,175,037 A * 12/1992 Merckens et al. ..... 428/57
5,361,808 A 11/1994 Bowen, Jr ..... 139/383
5,364,692 A 11/1994 Bowen, Jr. et al. ..... 428/222
5,449,548 A * 9/1995 Bowen, Jr. ..... 442/195
5,488,976 A * 2/1996 Lorenz et al. ..... 139/383 AA
5,514,456 A * 5/1996 Lefferts ..... 428/222
5,591,525 A 1/1997 Keller ..... 428/374
5,597,646 A * 1/1997 Keller ..... 442/192
5,617,903 A 4/1997 Bowen, Jr. ..... 139/383
5,732,749 A * 3/1998 Fargeout ..... 139/383 AA
5,819,811 A * 10/1998 Baker et al. ..... 139/383 AA
5,875,822 A * 3/1999 Fargeout ..... 139/383 AA
5,915,422 A 6/1999 Fagerholm ..... 139/383
5,998,310 A 12/1999 Bowen, Jr. ..... 442/196
6,176,271 B1 * 1/2001 Sayers et al. ..... 139/383 AA
6,194,331 B1 * 2/2001 Elkins ..... 442/225
6,302,155 B1 * 10/2001 Rydin ..... 139/383 AA
6,328,079 B1 * 12/2001 Zils ..... 139/383 AA
6,352,772 B1 * 3/2002 Keller ..... 428/364
6,589,392 B1 7/2003 Skinner et al. ..... 162/348
6,880,583 B2 * 4/2005 Billings ..... 139/383 AA

* cited by examiner

*Primary Examiner* — Bobby Muromoto, Jr.
(74) *Attorney, Agent, or Firm* — Frommer Lawrence & Haug LLP; Ronald R. Santucci; Vivek P. Shankam

(57) ABSTRACT

A connecting element for use in an industrial fabric. The connecting element includes a center portion and a plurality of lobes extending therefrom. The industrial fabric may be a spiral link fabric. The connecting element deforms under compression or tension reducing the fabric thickness and permeability.

9 Claims, 3 Drawing Sheets

PINTLE FOR SPIRAL FABRICS

CROSS-REFERENCE TO RELATED APPLICATIONS

This application is based upon and claims the benefit of U.S. Provisional Patent Application Ser. No. 60/529,488 filed Dec. 15, 2003 entitled "PENTALOBEL YARN AS PINTLE FOR SPIRAL FABRICS", the disclosure of which is incorporated herein by reference.

BACKGROUND OF THE INVENTION

1. Field of the Invention

The present invention relates to the papermaking arts. More specifically, the present invention relates to fabrics utilized on a papermaking machine. The invention is especially applicable to the production of dryer fabrics, but also may be used for forming fabrics, press fabrics and other industrial fabrics/belts that utilize a pintle or the like.

2. Description of the Related Art

During the papermaking process, a cellulosic fibrous web is formed by depositing a fibrous slurry, that is, an aqueous dispersion of cellulose fibers, onto a moving forming fabric in a forming section of a paper machine. A large amount of water is drained from the slurry through the forming fabric, leaving the cellulosic fibrous web on the surface of the forming fabric.

The newly formed cellulosic fibrous web proceeds from the forming section to a press section, which includes a series of press nips. The cellulosic fibrous web passes through the press nips supported by a press fabric, or, as is often the case, between two such press fabrics. In the press nips, the cellulosic fibrous web is subjected to compressive forces which squeeze water therefrom, and which adhere the cellulosic fibers in the web to one another to turn the cellulosic fibrous web into a paper sheet. The water is accepted by the press fabric or fabrics and, ideally, does not return to the paper sheet.

The paper sheet finally proceeds to a dryer section, which includes at least one series of rotatable dryer drums or cylinders, which are internally heated by steam. The newly formed paper sheet is directed in a serpentine path sequentially around each in the series of drums by a dryer fabric, which holds the paper sheet closely against the surfaces of the drums. The heated drums reduce the water content of the paper sheet to a desirable level through evaporation.

It should be appreciated that the forming, press and dryer fabrics all take the form of endless loops on the paper machine and function in the manner of conveyors. It should further be appreciated that paper manufacture is a continuous process which proceeds at considerable speeds. That is to say, the fibrous slurry is continuously deposited onto the forming fabric in the forming section, while a newly manufactured paper sheet is continuously wound onto rolls after it exits from the dryer section.

The above-mentioned fabrics may take many different forms. For example, they may be woven endless, or flat woven and subsequently rendered into endless form with a seam. Woven fabrics are typically in the form of endless loops, or are seamable into such forms, having a specific length, measured longitudinally therearound, and a specific width, measured transversely thereacross. Because paper machine configurations vary widely, paper machine clothing manufacturers are required to produce fabrics, and other paper machine clothing, to the dimensions required to fit particular positions in the paper machines of their customers.

Needless to say, this requirement makes it difficult to streamline the manufacturing process, as each fabric must typically be made to order.

Fabrics in modern papermaking machines may have a width of from 5 to over 33 feet, a length of from 40 to over 400 feet and weigh from approximately 100 to over 3,000 pounds. These fabrics wear out and require replacement. Replacement of fabrics often involves taking the machine out of service, removing the worn fabric, setting up to install a fabric and installing the new fabric. Because of the solid support beams for dryer sections, all dryer fabric must have a seam. Installation of the fabric includes pulling the fabric body onto a machine and joining the fabric ends to form an endless belt.

The seam region of any workable fabric must behave in use as close to the body of the fabric in order to prevent the periodic marking by the seam region of the paper product being manufactured.

Fabrics can be formed completely of spirals as taught by Gauthier, U.S. Pat. No. 4,567,077; which is incorporated herein by reference. In this case, the spirals are connected to each other by at least one connecting pin. In theory, the seam can therefore be at any location in the fabric body where a connecting pin may be removed. An advantage of a spiral fabric versus a woven fabric is the seam is geometrically similar to the fabric body.

The present invention provides a pintle or connecting element for use in holding together the spirals of a spiral link fabric. The connecting element deforms under compression or tension during processing, thereby reducing fabric thickness and permeability.

SUMMARY OF THE INVENTION

The invention provides a connecting element for use in an industrial fabric. The connecting element includes a center portion and a plurality of lobes extending therefrom. The industrial fabric is preferably a spiral link fabric. The connecting element deforms under compression or tension, resulting in a thinner fabric and reducing the permeability of the fabric to air, water, and the like.

The present invention will now be described in more complete detail with reference being made to the figures wherein like reference numerals denote like elements and parts, which are identified below.

BRIEF DESCRIPTION OF THE DRAWINGS

For a more complete understanding of the invention, reference is made to the following description and accompanying drawings, in which.

DETAILED DESCRIPTION OF THE PREFERRED EMBODIMENTS

A preferred embodiment of the present invention will be described in the context of a papermaking dryer fabric. However, it should be noted that the present invention may be applied to spiral link fabrics used in other sections of a paper machine, as well as to those used in other industrial settings. The spiral link fabric includes a plurality of transverse spirals which may be interdigitated and connected together by a connecting element. Note the present invention may have applications in other type fabrics or in seaming applications where pintles of this type may be desirable.

Figure 1:
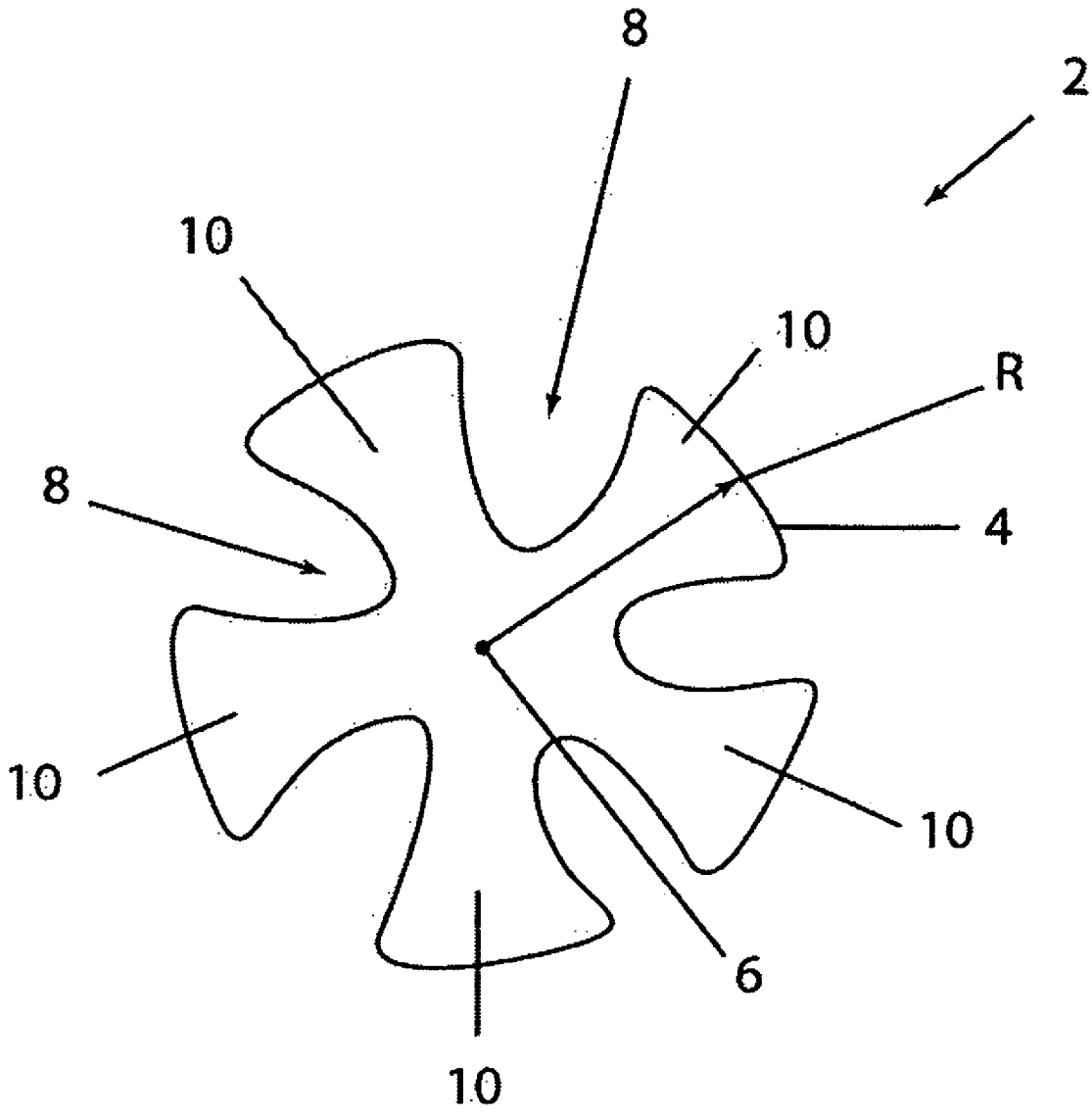
FIG. 1 is a cross-sectional view of a connecting element in accordance with an embodiment of the present invention.

An embodiment of the present invention will now be described with reference to FIG. 1 which is a cross-sectional view of a connecting element, pintle or pin 2. Connecting element 2 may be inserted into a channel formed from interdigating spiral links, coils or loops in a fabric.

The connecting element 2 may include a center portion 6 having a substantially circular cross-section and a number of lobes 10 each having an outer surface 4 and each extending from the central portion. In one embodiment, the connecting element 2 has five lobes 10 and accordingly may be termed a pentalobal yarn. Adjacent lobes are separated from each other by a groove 8 having a predetermined shape such as a "C" shape. The outer surface 4 of the connecting element 2 may have a curved shape, such as illustrated in FIG. 1. As such, the connecting element can be considered as having a substantially circular cross-sectional shape with a radius R as measured from the center of the connecting element. The arrangement, size, and/or shape of the grooves 8 and lobes 10 allow the connecting element 2 to deform under compression or tension. Specifically, when subjected to a compression or tension load during processing, connecting element 2 will deform to achieve a fabric thickness smaller than the original thickness of the fabric coils forming the channel.

Connecting element 2 may be a homogenous monofilament formed from any polymeric resin, such as polyamide and polyester resins. Connecting element 2 can, as will be appreciated by those skilled in the art, contain a wide variety of additives typically used in the preparation of monofilaments to modify the appearance and performance characteristics, such as anti-oxidants, dyes, pigments, antistatic agents and ultraviolet stabilizers. Alternatively, the connecting element 2 may be fabricated from a metal or metals or other materials, which may or may not contain additives. Such connecting element 2 may be formed from an extrusion process (such as a melt extrusion process) using a die. In such situation, the shape of the die may determine the shape of the connecting element.

As mentioned above, the original shape of the connecting element 2 may allow it to deform under compression or tension to obtain a fabric thickness smaller than the original thickness of the fabric spiral coils. For example, in a calendering process, the spiral link fabric may be pressed between two rollers forming a nip. Such compression will cause the connecting element to deform and reduce the overall thickness dimension of the spiral coil.

Figure 2:
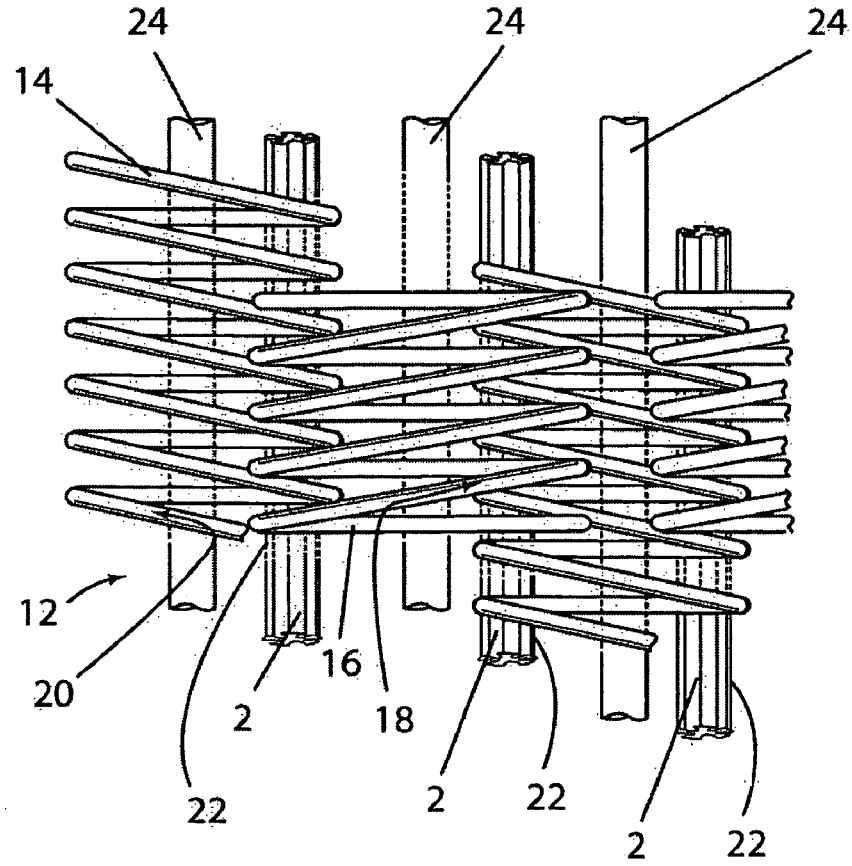
FIG. 2 is a partial view of a spiral link fabric having a plurality of the connecting elements of FIG. 1.
Figure 3:
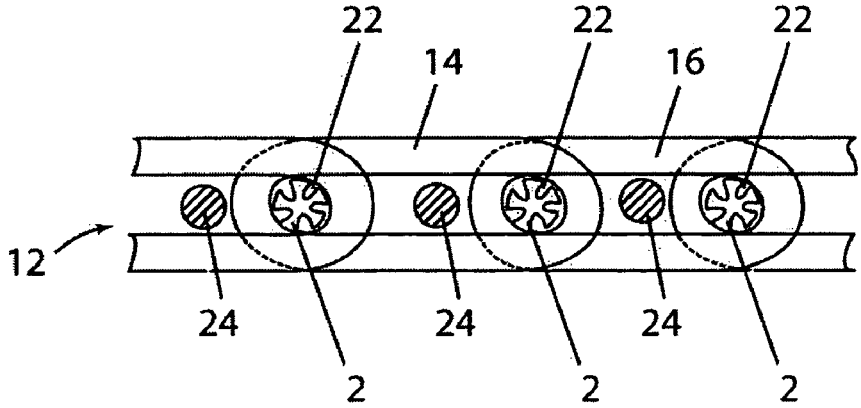
FIG. 3 is a partial side cross-sectional view of the spiral link fabric of FIG. 2.

FIGS. 2 and 3 respectively illustrate a top view and a cross-sectional view of a spiral link fabric 12. As shown therein, such fabric 12 may include spirals 14 and 16 which are substantially disposed in a direction transverse relative to the longitudinal axis of the fabric (which is along the running direction of the fabric). The turns of spirals 14 and 16 may be inclined in a predetermined manner. As an example, the turns of spiral 14 may be inclined to the left as shown by arrow 20 and the turns of spiral 16 may be inclined to the right as shown by arrow 18. The spirals 14 and 16 are coupled together by connecting elements 2. Specifically, connecting elements 2 may be inserted or otherwise disposed in channels 22 formed by interdigitating spirals 14 and 16.

Further, stuffer yarns 24 may be inserted or otherwise disposed between or within spirals 14 or 16 so as to fill gaps therein to further reduce the permeability of the fabric 12. Stuffer yarns 24 may be yarns or strips of material and may have any shape suitable for the purpose.

Figure 4A:
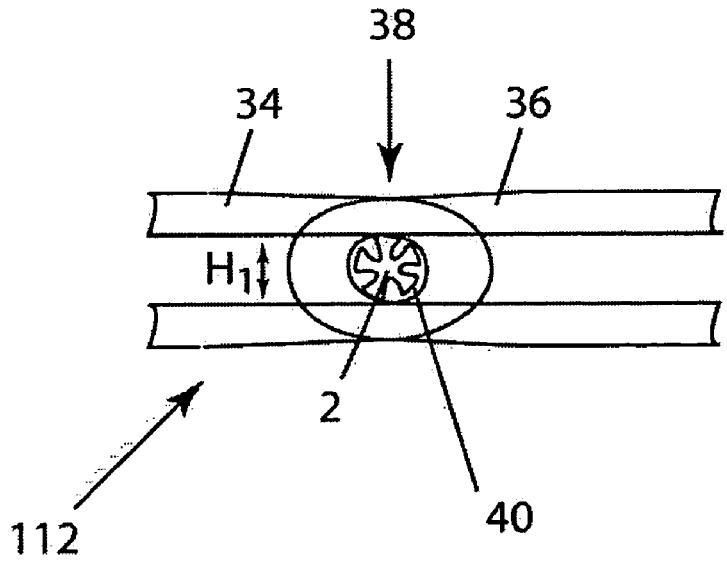
FIG. 4*a* is an enlarged view of the connecting element of FIG. 1 disposed in a loop of a fabric before compression or tension.
Figure 4B:
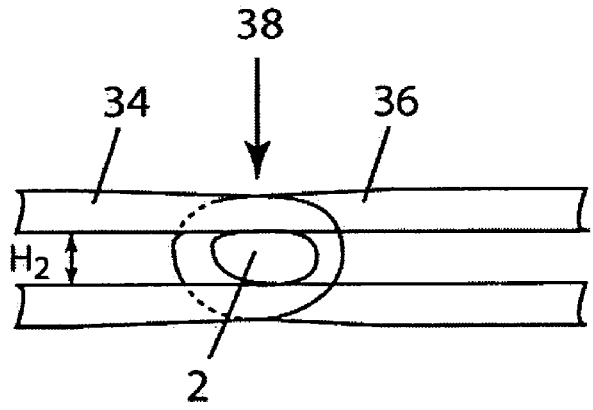
FIG. 4*b* is an enlarged view of the connecting element of FIG. 4*a* after compression or tension.

FIG. 4*a* is a cross-sectional view of connecting element 2 disposed in a loop of a spiral link fabric 112 before being subjected to an operational compression or tension load. In such arrangement, spiral coils 34 and 36 have been interdigitated to form a channel 38 having a substantially circular or oval-shape with a height $H_1$. When the fabric 112 is compressed during processing, for example in a calendering operation, coils 34 and 36 and connecting elements 2 may be deformed or changed so as to have a height $H_2$, as shown in FIG. 4*b*. Such height $H_2$ is less than the height $H_1$.

Therefore, the present connecting element 2 will result in a thinner fabric with lower permeability.

Although the connecting element has been described as having five lobes (pentalobal) and a substantially circular cross-sectional shape, the present invention is not so limited. Instead, the connecting element may have any cross-sectional shape that deforms under processing compression or tension to yield a fabric with a thickness smaller than the thickness of the original fabric. In addition, the present connecting element may have any number of lobes 10 each having any shape. As an example, grooves 8 may have a "C"-shape or a "U"-shape cross-section, or a combination thereof. As another example, each of the lobes and grooves may have different sizes and/or shapes.

Modifications to the above would be obvious to those of ordinary skill in the art, but would not bring the invention so modified beyond the scope of the present invention.

Thus by the present invention its advantages are realized and although preferred embodiments have been disclosed and described in detail herein, their scope should not be limited thereby; rather their scope should be determined by that of the appended claims.

What is claimed is:

1. An industrial fabric comprising a plurality of links, coils or loops, which are joined and held together by a pintle yarn placed in a channel formed between successive links, coils or loops, wherein said pintle yarn includes a center portion and a portion thereof which is deformable under compression or tension, wherein said deformation occurs towards a central axis of said center portion, thereby creating a circular or continuous yarn shape.

2. The industrial fabric of claim 1, wherein said pintle yarn comprises a center portion and a plurality of lobes extending therefrom.

3. The industrial fabric of claim 2, wherein said pintle yarn has five lobes.

4. The industrial fabric of claim 3, wherein said pintle yarn has a substantially circular cross-sectional shape.

5. The industrial fabric of claim 1, wherein said industrial fabric is a papermaking dryer fabric.

6. The industrial fabric of claim 1, wherein said coils are spiral and successive ones interdigitated with each other.

7. The industrial fabric of claim 6, which further includes stuffer yarns.

8. The industrial fabric of claim 1, wherein said pintle yarns comprise monofilaments, which include antioxidants, dye, pigment, antistatic agents or ultraviolet stabilizer.

9. The industrial fabric of claim 1, wherein said pintle yarn is made from a polymer or a metal.

* * * * *